US011470874B2

(12) United States Patent
Cieslikowski

(10) Patent No.: US 11,470,874 B2
(45) Date of Patent: Oct. 18, 2022

(54) FEEDING APPARATUS FOR FEEDING A TOBACCO INDUSTRY SEGMENT

(71) Applicant: International Tobacco Machinery Poland Sp. z o. o., Radom (PL)

(72) Inventor: Bartosz Cieslikowski, Radom (PL)

(73) Assignee: International Tobacco Machinery Poland Sp. z o. o., Radom (PL)

( * ) Notice: Subject to any disclaimer, the term of this patent is extended or adjusted under 35 U.S.C. 154(b) by 127 days.

(21) Appl. No.: 16/948,913

(22) Filed: Oct. 6, 2020

(65) Prior Publication Data

US 2021/0112850 A1 Apr. 22, 2021

(30) Foreign Application Priority Data

Oct. 21, 2019 (EP) ..... 19204378

(51) Int. Cl.

| | |
|---|---|
| ***A24C 5/32*** | (2006.01) |
| ***A24C 5/12*** | (2006.01) |
| ***A24C 5/34*** | (2006.01) |

(52) U.S. Cl.

CPC ..... *A24C 5/327* (2013.01); *A24C 5/12* (2013.01); *A24C 5/325* (2013.01); *A24C 5/3412* (2013.01)

(58) Field of Classification Search

CPC .. A24C 5/12; A24C 5/32; A24C 5/325; A24C 5/327; A24C 5/3412; A24D 3/0287

See application file for complete search history.

(56) References Cited

U.S. PATENT DOCUMENTS

| | | | | |
|---|---|---|---|---|
| 6,264,591 | B1 | 7/2001 | Keen et al. | |
| 2007/0117700 | A1* | 5/2007 | Kushihashi | A24D 3/0295 493/39 |
| 2009/0145449 | A1 | 6/2009 | Cieslikowski et al. | |
| 2017/0143033 | A1* | 5/2017 | Sikora | A24D 3/0287 |

FOREIGN PATENT DOCUMENTS

| | | | |
|---|---|---|---|
| EP | 2622973 | B1 | 7/2017 |
| EP | 2243385 | A2 | 11/2017 |
| WO | 2009099793 | A2 | 8/2009 |
| WO | 2011139169 | A1 | 11/2011 |
| WO | 2015135610 | A1 | 9/2015 |

OTHER PUBLICATIONS

European Search Report in Application No. EP19204378.

* cited by examiner

*Primary Examiner* — Eric Yaary

(74) *Attorney, Agent, or Firm* — Oppedahl Patent Law Firm LLC

(57) ABSTRACT

A feeding apparatus for feeding a tobacco industry segment (C) comprising a hopper (12) for rods (10C) with a length being a multiple length of the segment (C), a cutting a conveying unit (13), situated underneath the hopper (12) for the rods (10C), for cutting the rods (10C) into individual segments (C), whereas from the rod (10C), after cutting the rod (10C), a group (G) of the segments (C) is formed, a transferring unit (15) situated underneath the cutting and conveying unit (13), adapted to receive the groups (G) of the segments (C) and to form of them a stream (SF) of the segments (C), whereas the gaps (U) between the groups (G) of the segments (C) in the stream (SF) are retained, and the transferring unit (15) is adapted to reduce the gaps (U) between the groups (G) so that at the outlet (23) of the transferring unit (15) the segments (C) are conveyed without gaps.

6 Claims, 5 Drawing Sheets

FEEDING APPARATUS FOR FEEDING A TOBACCO INDUSTRY SEGMENT

BACKGROUND

The invention is a feeding apparatus for feeding tobacco industry segments.

In the tobacco industry products, filter tips containing filter materials are commonly used. Both filter tips made of one kind of filter material and multi-segment filter tips of several kinds of filter material are in common use. Both filter tips made of one kind of filter material and multi-segment filter tips may comprise additional elements such as beads containing aromatic substances or inserts absorbing the odour of a smoked cigarette. Such beads may be placed into a continuous rod of the filter material by means of bead feeding apparatuses as shown for example in EP2622973B1, such continuous rod is cut into individual filter rods comprising several beads. A method for checking presence and quality of the beads in such continuous filter rod is known from the application EP2243385A2. Individual segments formed after cutting the continuous rod form a part of a multi-segment filter or are stuck directly to the tobacco part. The presence and the quality of the beads placed in a finished product such as a cigarette may be checked as described in the publication WO2009099793A2 in the filter tip attached to the cigarette, or in the publication WO2015135610A1 during the transverse movement of two cigarettes before they are cut into two individual cigarettes. Due to possible cracks of the beads, they should be checked at different production stages before placing them into the continuous rod, after cutting the continuous rod into single rods, before attaching a segment formed from the rod, and in a finished product. It is very important to check the quality of the beads before attaching the segments to the tobacco part because any subsequent detection of a damaged bead and reclaiming tobacco from a cigarette with a stuck filter tip are costly and difficult. Moreover, a close proximity of the segments (for example containing activated charcoal) in a multi-segment rod or in an individual multi-segment filter may interfere with the measurement of the filling and of the position of beads placed in the segments of a filter material, for example of acetate.

SUMMARY OF THE INVENTION

The invention is a feeding apparatus for feeding a tobacco industry segment comprising a hopper for rods with a length being a multiple length of the segment, a cutting and conveying unit, situated underneath the hopper for rods, for cutting the rods into individual segments. From a rod, after cutting the rod, a group of the segments is formed. The apparatus further comprises a transferring unit, situated underneath the cutting and conveying unit, adapted to receive the groups of segments and to form of them a stream of segments. There are gaps retained between the groups of segments in the stream. The transferring unit is adapted to reduce the gaps between the groups so that at the outlet of the transferring unit the segments are conveyed without gaps. The apparatus according to the invention is characterised in that the feeding apparatus is provided with a sensor situated in the outlet area of the transferring unit. The sensor is adapted to check at least one of segment parameters of a group of parameters comprising: presence of an object in the segment, quality of the object situated in the segment, position of the object in the segment, quality of the segment.

Preferably, the apparatus according to the invention is characterized in that the sensor is a microwave sensor.

The apparatus according to the invention is further characterized in that the sensor is an optical sensor.

The apparatus according to the invention is further characterized in that the sensor is an x-ray sensor.

The apparatus according to the invention is characterized in that the transferring unit is provided with a transferring drum, adapted to reduce the gaps between the groups, provided with a spiral element on its lateral surface. The distance between the adjacent coils of the spiral element in the direction parallel to the direction of the transferring drum decreases in the direction towards the outlet of the transferring unit.

The apparatus according to the invention is characterized by being provided with a separating unit for separating an individual segment from a stream of segments, comprising a rotatable cam for pushing the segment out of the stream.

The apparatus according to the invention is characterized by being provided with a positioning unit for placing the segment onto a conveyor adapted to convey a train of segments, whereas the positioning unit comprises a positioning disc.

The apparatus according to the invention, in view of the advantageous positioning of the sensor, allows obtaining more accurate measurements of parameters of a filter segment and parameters of objects inside such segment. The manufacture of multi-segment filters takes place at multiple stages, the filter rods are cut into segments which are wrapped into successive layers of the wrapping material, whereas successive layers of glue and wrapping material make the measurements difficult, and additionally may cause measurement interference. In the apparatus according to the invention, the sensor is situated at a place where the segment is wrapped by a minimum number of cigarette paper layers. The invention, in combination with known techniques for monitoring the position of an identified segment at the entire length of the production line, makes it possible to reject segments with parameters not meeting the quality standards. In the production line, the measurements are made at all production stages, adding a measurement apparatus at the early production stage will improve the quality control system and reduce the quantity of rejected defective products at further production stages.

DESCRIPTION OF THE DRAWING

The invention is shown in detail in an exemplary embodiment in a drawing in which.

DETAILED DESCRIPTION

Figure 1:
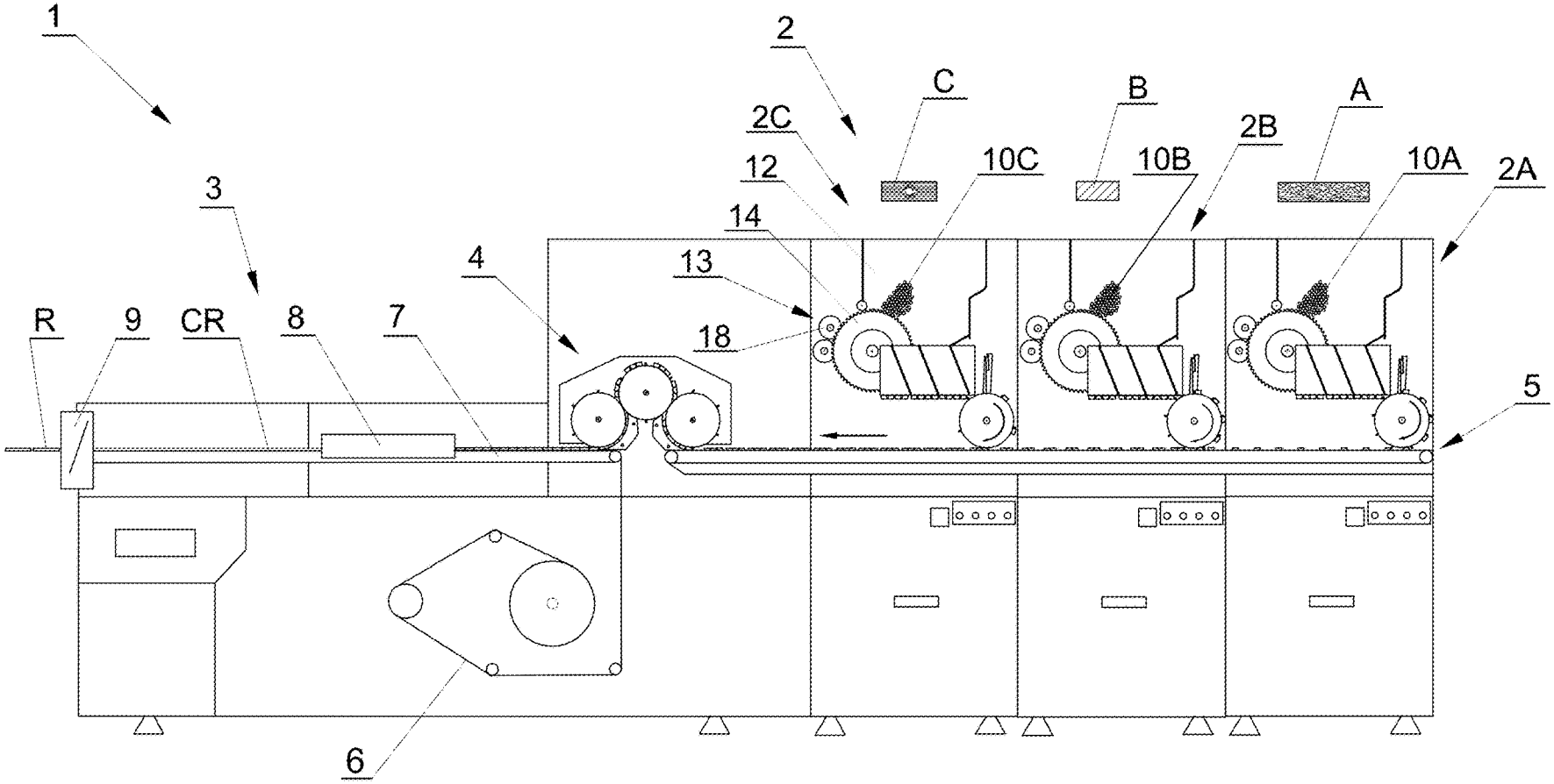
FIG. 1 shows a view of a production machine.

The production machine 1 shown in FIG. 1 is used to manufacture multi-segment filter rods R. The production machine 1 comprises a feeding part 2 and a forming part 3.

Figure 2:
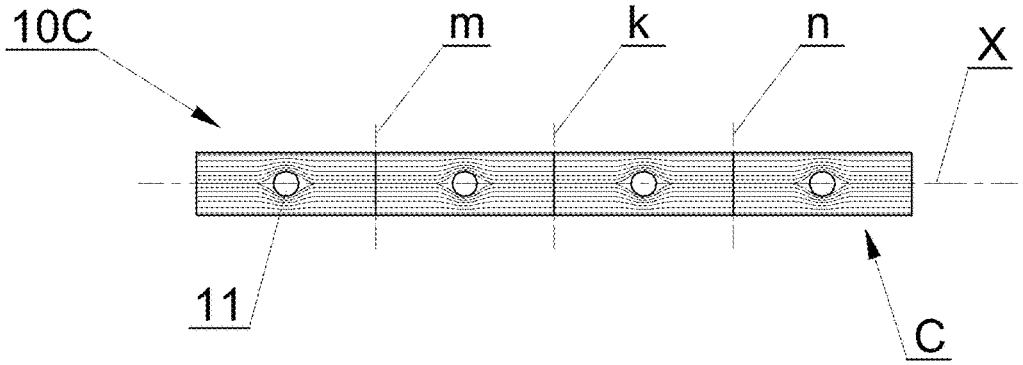
FIG. 2 shows a rod containing the beads.

The feeding part 2 comprises feeding modules 2A, 2B, 2C, whereby semi-finished products in the form of filter rods 10A, 10B, 10C are supplied to the feeding modules 2A, 2B, 2C of the feeding part 2. The filter rods 10A, 10B, 10C are cut into segments A, B, C in the individual modules, whereby the rods 10A, 10B, 10C having lengths being multiple lengths of the segments A, B, C. The segments A, B, C are fed to the forming part 3, where these segments are used to form a continuous multi-segment filter rod CR which is cut into individual multi-segment filter rods R. The feeding part 2 of the machine 1 is provided with a grouping conveyor 5 designed to convey the segments A, B, C in a predetermined sequence. Between the feeding part 2 and the forming part 3, there is a transferring module 4 which transfers the segments A, B, C from the feeding part 2, maintaining their sequence. The rod-like articles A, B, C are transferred to the forming part 3 and placed onto a tape of a wrapping material 6 conveyed on a conveyor 7 and wrapped into the strip of the wrapping material 6 in a forming unit 8. The continuous rod CR is cut into the individual multi-segment filter rods R by means of a cutting head 9. FIG. 2 shows a rod 10C having the length of four segments C. The rod 10C has four beads 11 and, in the feeding module 2C, is cut into four segments C, whereby in each segment C one bead 11 is placed. In practice, the rods may be provided with any kind of objects of various shapes, fulfilling various functions, and the rods may be cut into any number of segments so that in one segment one or more object(s) is(are) placed. In one segment, there may be situated different objects. The rod 10C is cut first in the plane k which is perpendicular to the axis X of the rod 10C, and then in the planes m and n which are parallel to the plane k.

Figure 3:
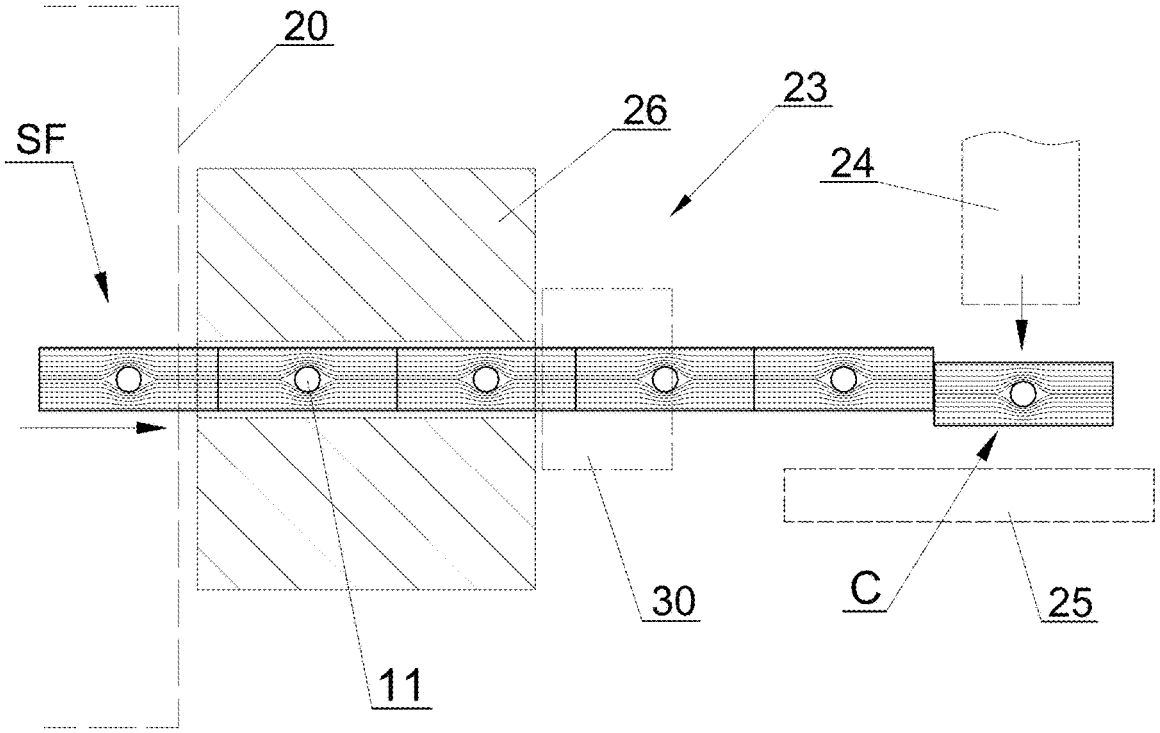
FIG. 3 shows a stream of segments moving through the sensor.
Figure 4:
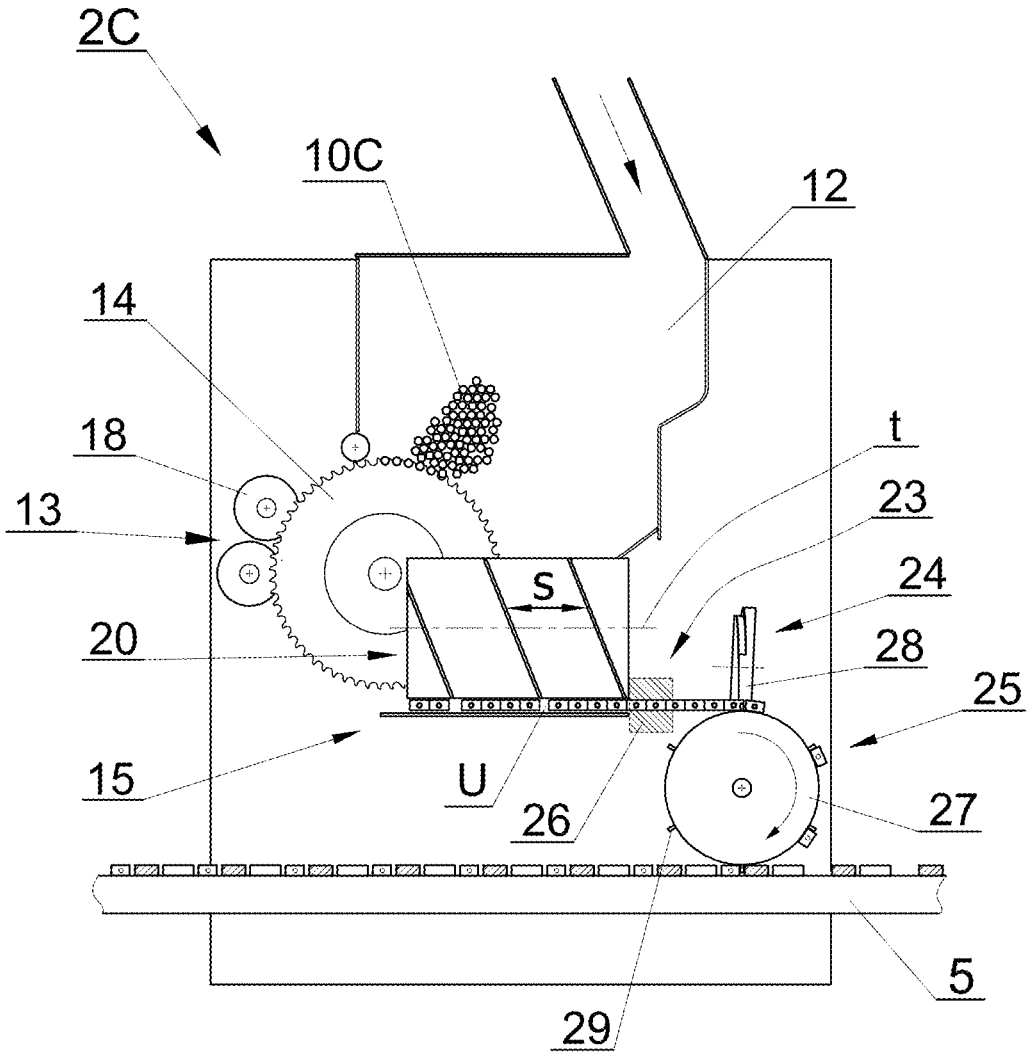
FIG. 4 shows a module of the production machine of FIG. 1 in a front view.
Figure 5:
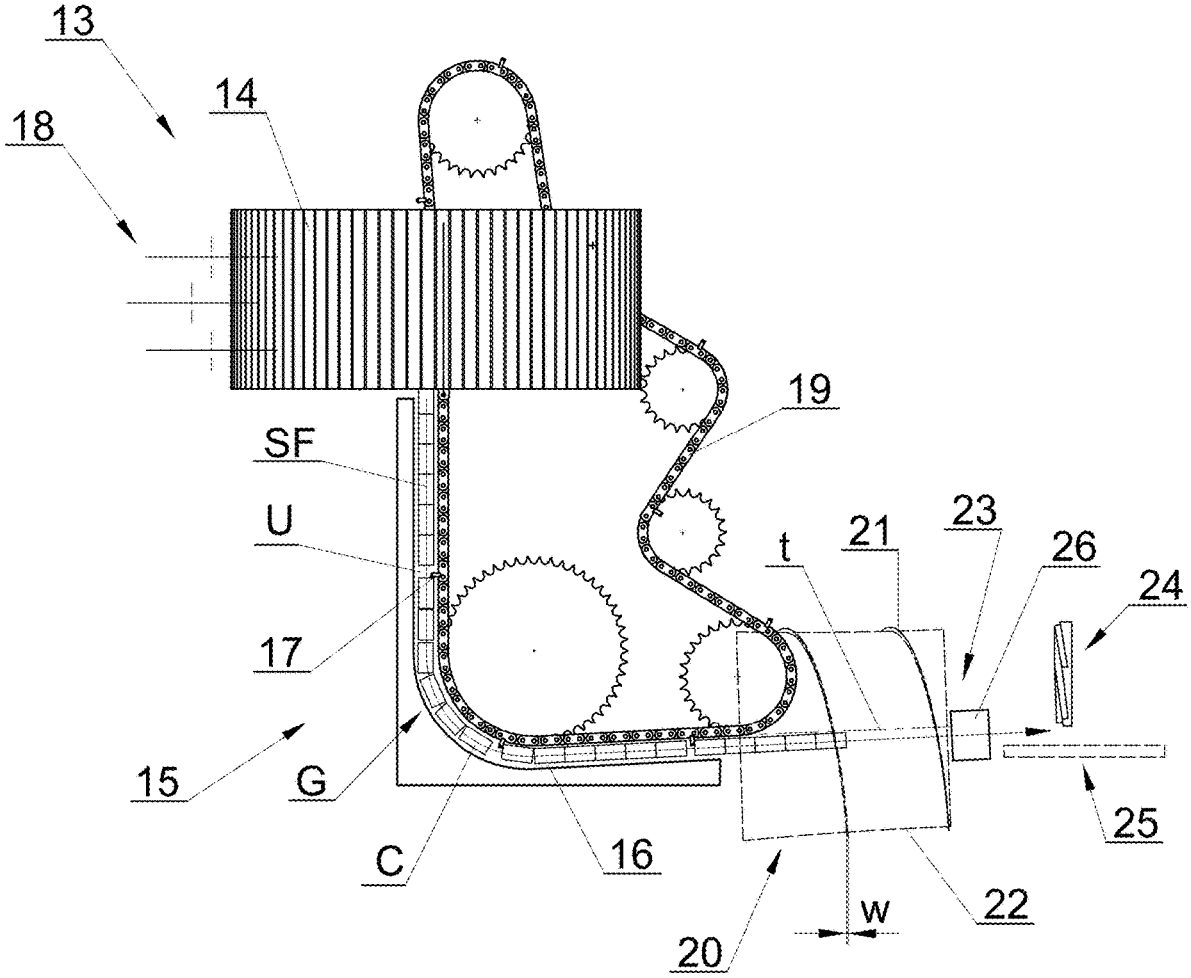
FIG. 5 shows a segment of the module of FIG. 4 in a top view.

The feeding module 2C comprises a hopper 12 in which the rods 10C are contained (FIG. 4). Underneath the hopper 12, there is situated a cutting and conveying unit 13 comprising a multi-groove cutting drum 14 next to which a circular knife unit 18 is situated. The feeding module 2C comprises a transferring unit 15 situated directly underneath the cutting drum 14 and is adapted to convey a stream SF of the segments C. The filter rods 10C are placed into the grooves of the drum conveyor 14, and the segments C formed after cutting as groups G of the segments C are received by the transferring unit 15 from successive grooves of the drum conveyor 14. In the transferring unit 15, the stream SF of the segments C is formed (FIG. 5). The segments C are transferred along a substantially horizontal channel 16, whereas the segments C are transferred in the groups G by means of lugs 17 attached to a chain 19, gaps U are retained between the groups G in the stream SF. The gaps U must be retained due to receiving the groups G from separate grooves of the cutting drum 14 and due to the need of pushing the groups G by means of the lugs 17. In the embodiment shown, the segments C are transferred further by means of a transferring drum 20 provided with a spiral element 21 situated on the lateral surface 22 of the transferring drum 20, the spiral element 21 pushes the segments C during the rotation of the transferring drum 20. The distance S between adjacent coils of the spiral element 21 (FIG. 4) in a direction parallel to the axis of the transferring drum 20 is variable and decreases in the direction of movement of the segments C in the stream SF, in the drawing to the right towards the outlet 23 of the transferring unit 15. Furthermore, the thickness of the spiral element decreases in the direction of movement of the segments C. By using the transferring drum 20 provided with the spiral element 21 in the stream of the segments C the gaps U between the groups G are eliminated. The segments C of the continuous stream SF (without gaps between the segments C) are transferred directly or by means of a separating unit 24 to a positioning unit 25 comprising a positioning disc 27 with lugs 29 disposed on its circumference. The separating unit 24 comprises a rotatable cam 28 for pushing out one segment C from the stream SF as shown in FIG. 3. In the area of the outlet 23 of the transferring unit 15, there is situated a sensor 26 which may be an optical, electromagnetic, microwave, x-ray or any other sensor serving to check the segment quality taking into account the quality of objects placed inside. The sensor 26 may be adapted to check at least one of the features of a group comprising presence of an object 11, quality of the object 11, for example the shape or filling of the object 11 with an aromatic substance, position of the object 11 in the segment C in the longitudinal direction, for example a central position between the end surfaces of the segment C, quality of the segment C, for example the fibre density or a defective filling of the segment C with the filter material.

Figure 6:
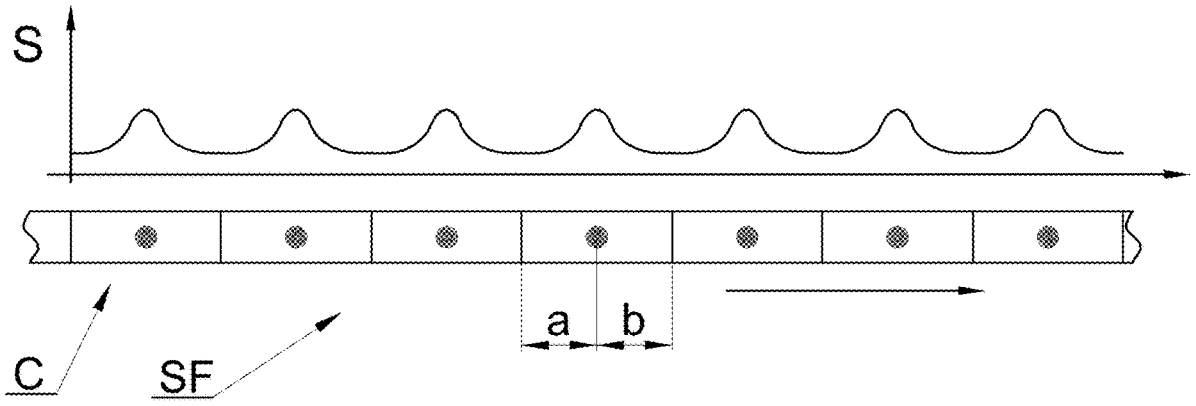
FIG. 6 shows a stream of good quality segments and a corresponding waveform of the sensor signal.
Figure 7:
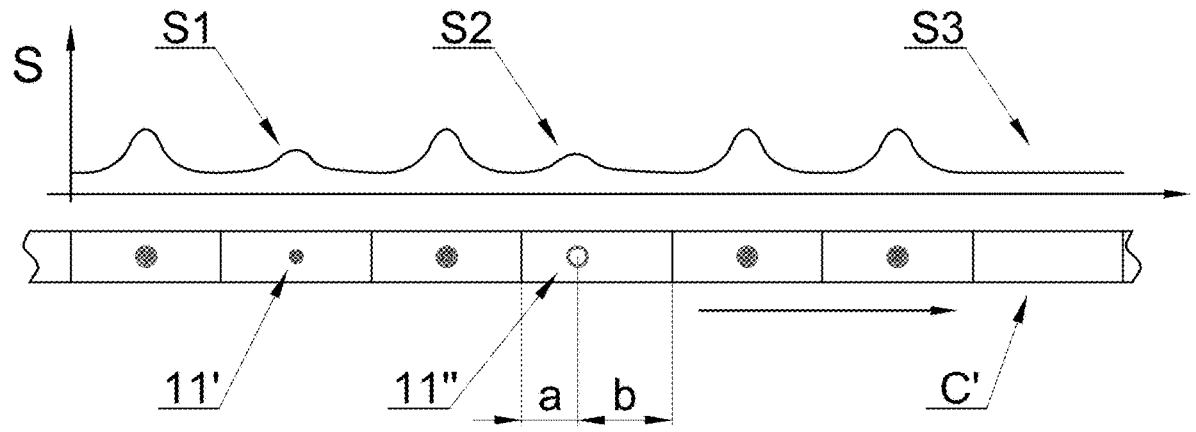
FIG. 7 shows a stream containing bad quality segments and a corresponding waveform of the sensor signal.

The essential parameters of quality of an example segment C are above all the presence of the object 11 in the segment C and the quality of such object. FIG. 6 shows the segments C in the moving stream SF and the variability of the signal S generated by the sensor 26 for such stream in a situation where the segments C in the stream SF are correctly made and each contains a bead. All segments C shown are of good quality, and in addition the beads are disposed at equal distances from the end surfaces of the segments, i.e. the distance a is equal to the distance b. In the case of a bead, an essential quality parameter is the filling of the bead with an aromatic substance, in addition, the size of the bead is taken into consideration. Both the filling of the bead with an aromatic substance and the size of the bead may be checked by measuring the amount of the aromatic substance. FIG. 7 shows the stream SF in which the object 11' is too small (the signal S1 is weakened compared to the signal shown in FIG. 6), the object 11" is not situated at equal distances from the ends of the segment, i.e. the distance a is different from the distance b, in addition, the object 11" is not correctly filled with the aromatic substance (the signal S2 is weakened and shifted), whereas the segment C' does not have any object inside (the signal S3 shows the absence of an object). In the stream SF, the correctness of filling of the segment C with the filter material both by means of the sensor 26 and by means of an additional sensor 30 situated next to the sensor 26 may also be analysed (FIG. 3).

The storage container 12 together with the cutting and conveying unit 13 comprising the cutting drum 14 and the circular knives 18, and with the transferring unit 15 constitute a feeding apparatus for feeding a stream of the segments C to the separating apparatus 24 or to any other apparatus which requires the feeding with a stream of segments.

The task of the separating unit 24 is to separate one segment C from the stream SF of the segments C. The storage container 12 together with the cutting and conveying unit 13 comprising the cutting drum 14 and the circular knives 18, the transferring unit 15 and the separating apparatus 24 constitute an apparatus for feeding the segment C to the positioning unit 25 or to any other apparatus which requires the feeding with individual segments.

The task of the positioning unit 25 is to place the segments C onto a grouping conveyor 5. The storage container 12 with the cutting and conveying unit 13 comprising the cutting drum 14 and the circular knives 18, the transferring unit 15, the separating apparatus 24 and the positioning unit 25 constitute an apparatus for feeding the segment C onto the grouping conveyor 5 or to any other apparatus which requires the feeding with individual segments.

If a defect of the segment C, in particular a defect of an object placed inside the segment C is detected, the manufactured multi-segment filter rod R containing such segment is rejected, whereas such rejection may take place only behind the production machine 1.

The invention claimed is:

1. A feeding apparatus for feeding a tobacco industry segment (C) comprising a hopper (12) for rods (10C) with a length being a multiple length of the segment (C), a cutting and conveying unit (13), situated underneath the hopper (12) for the rods (10C), for cutting the rods (10C) into individual segments (C), whereas from the rod (10C), after cutting the rod (10C), a group (G) of the segments (C) is formed, a transferring unit (15), situated underneath the cutting and conveying unit (13), adapted to receive the groups (G) of the segments (C) and to form of them a stream (SF) of the segments (C), whereas gaps (U) between the groups (G) of the segments (C) in the stream (SF) are retained, and the transferring unit (15) is adapted to reduce the gaps (U) between the groups (G) so that at an outlet (23) of the transferring unit (15) the segments (C) are conveyed without gaps, characterized in that the feeding apparatus is provided with a sensor (26) situated in the area of the outlet (23) of the transferring unit (15), whereas the sensor (26) is adapted to check at least one of segment (C) parameters of a group of parameters comprising: presence of an object (11) in the segment (C), quality of the object (11) situated in the segment (C), position of the object (11) in the segment (C), and quality of the segment (C), further characterized in that the transferring unit (15) is provided with a transferring drum (20), adapted to reduce the gaps (U) between the groups (G), provided with a spiral element (21) on its lateral surface (22), whereas the distance (S) between adjacent coils of the spiral element (21) in the direction parallel to an axis (t) of the transferring drum (20) decreases in the direction towards the outlet (23) of the transferring unit (15).

2. The apparatus as in claim 1, characterized in that the sensor (26) is a microwave sensor.

3. The apparatus as in claim 1, characterized in that the sensor (26) is an optical sensor.

4. The apparatus as in claim 1, characterized in that the sensor (26) is an x-ray sensor.

5. The apparatus as in claim 1, characterized by being provided with a separating unit (24) for separating an individual segment (C) from the stream (SF) of the segments (C), comprising a rotatable cam (28) for pushing the segment (C) out of the stream (SF).

6. The apparatus as in claim 5, characterized by being provided with a positioning unit (25) for placing the segment (C) onto a conveyor (5) adapted to convey a train of segments (A, B, C), whereas the positioning unit (25) comprises a positioning disc (27).

* * * * *